US008109646B2

(12) United States Patent
Newell

(10) Patent No.: US 8,109,646 B2
(45) Date of Patent: Feb. 7, 2012

(54) SELF-CENTERING PULL-OUT LIGHT TUBE ASSEMBLY

(75) Inventor: Steven H. Newell, Petaluma, CA (US)

(73) Assignee: Panamax Corporation, Petaluma, CA (US)

( * ) Notice: Subject to any disclaimer, the term of this patent is extended or adjusted under 35 U.S.C. 154(b) by 393 days.

(21) Appl. No.: 12/502,094

(22) Filed: Jul. 13, 2009

(65) Prior Publication Data

US 2010/0014285 A1 Jan. 21, 2010

Related U.S. Application Data

(60) Provisional application No. 61/082,121, filed on Jul. 18, 2008.

(51) Int. Cl.
*F21V 21/22* (2006.01)

(52) U.S. Cl. ..... 362/217.01

(58) Field of Classification Search ..... 362/30, 362/85, 86, 89, 217.01, 220, 424, 425
See application file for complete search history.

(56) References Cited

U.S. PATENT DOCUMENTS

| | | | | |
|---|---|---|---|---|
| 4,894,755 | A * | 1/1990 | Chandler | 362/506 |
| 5,144,542 | A * | 9/1992 | Puglisi | 362/386 |
| 2003/0012013 | A1* | 1/2003 | Herrera | 362/99 |
| 2007/0103907 | A1* | 5/2007 | Popowich et al. | 362/277 |

* cited by examiner

*Primary Examiner* — David V Bruce
(74) *Attorney, Agent, or Firm* — DLA Piper LLP (US)

(57) ABSTRACT

A pull-out light tube assembly is mounted in an equipment component such as a component that is mounted in an equipment rack. The light tube assembly includes a light tube received within a bushing. The light tube can be pulled out from the bushing and retracted into the bushing. The assembly includes a mechanism for self-centering the light tube within the bushing when the light tube is retracted into the bushing. A guide channel formed in the bushing receives and guides a guide pin formed in the light tube to a centered position. The guide channel may be a V-shaped groove with a receptacle and detent formed at an end thereof to secure the guide pin in a centered position. The mechanism for self-centering maintains a logo formed at a front end of the light tube in a properly oriented position when the light tube is retracted within the bushing.

8 Claims, 8 Drawing Sheets

SELF-CENTERING PULL-OUT LIGHT TUBE ASSEMBLY

CROSS-REFERENCE TO RELATED APPLICATIONS

This application claims the benefit of priority under 35 USC 119 of U.S. provisional application No. 61/082,121, filed on Jul. 18, 2008.

BACKGROUND OF THE INVENTION

1. Field of the Invention

The present invention relates to a pull-out light tube assembly for an equipment rack or other assembly, and more particularly to a pull-out light tube assembly with a mechanism for self-centering on retraction.

2. Description of Related Art

Pull-out light tube assemblies have been provided for assemblies such as rack-mount systems for audio and video equipment. The light tube assembly includes a light tube that can be pulled out of, and retracted into, a bushing or holder formed in a front panel of an equipment or component mounted in the rack. A lamp or bulb is mounted inside of the light tube, and the light tube includes at one end (the pulled out end) a light opening through which light from the lamp shines in order to illuminate portions of surrounding equipment in the rack.

In one configuration, the light opening is provided in a lower portion of the light tube, and the light tube is rotatable within the bushing so that light can be shined on a desired part of the equipment rack. Thus, when pulled out, light can be shined through the light opening to illuminate equipment directly below the light tube, or the light tube can be rotated to aim the light opening in order to illuminate equipment to the sides of the light tube. When no longer needed, the light tube is pushed back into the bushing.

A manufacturer or decorative logo, such as a letter or a symbol, may be provided at a front end of the light tube in order to improve the ornamental appearance and design of the light tube when retracted into the bushing, and/or to designate the manufacturer of the light tube assembly. However, when known light tubes are pulled out from the bushing and rotated, and then pushed back or retracted into the bushing without being rotated back to the original position, the logo at the front end of the light tube will remain at a rotated and off-center position, thereby not being properly oriented and detracting from the appearance of the light tube assembly and equipment rack in which it is installed. At present, the only known method for returning the light tube assembly to a centered and more visually appealing position is by manual rotation of the light tube back to its centered position. However, the user of the light tube may very likely forget or neglect to take this restorative action, thereby leaving the light tube assembly in an improperly oriented and visually less appealing state.

SUMMARY OF THE INVENTION

The present invention addresses this problem and provides a mechanism for self-centering a pull-out light tube assembly when the light tube is pushed back or retracted into its bushing or holder.

In particular, the present invention provides a pull-out light tube assembly that can be mounted in an equipment component such as a component that is mounted in an equipment rack. The light tube assembly includes a light tube received within a bushing. The light tube can be pulled out from the bushing and retracted into the bushing. The assembly includes a mechanism for self-centering the light tube within the bushing when the light tube is retracted into the bushing.

In one embodiment of the invention, a guide pathway formed in the bushing receives and guides a guide pin formed in the light tube to a centered position. The guide pathway may be a V-shaped groove with a receptacle and detent formed at an end thereof to secure the guide pin in a centered position.

In one embodiment of the invention, the mechanism for self-centering maintains a logo formed at a front end of the light tube in a properly oriented position when the light tube is retracted within the bushing.

Other features and advantages of the invention will be apparent from the following detailed description, taken in conjunction with the accompanying drawings that illustrate, by way of example, various features of embodiments of the invention.

DETAILED DESCRIPTION OF THE INVENTION

FIGS. 1-4 illustrate an exemplary component or piece of equipment 10 having a pull-out light tube assembly 12 installed therein according to the present invention. Equipment or component 10 may be, for example, audio or video equipment configured to be mounted within an equipment rack. While equipment 10 is illustrated as having two pull-out light tube assemblies installed therein, it may have any other number of light tube assemblies installed therein.

Figure 1:
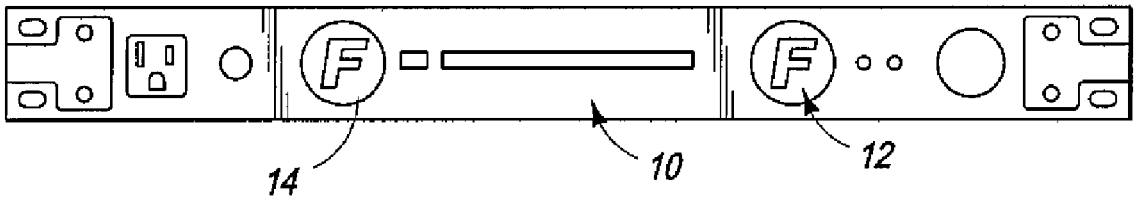
FIG. 1 is a front view of equipment having a pull-out light tube assembly in a retracted state, according to the present invention.
Figure 2:
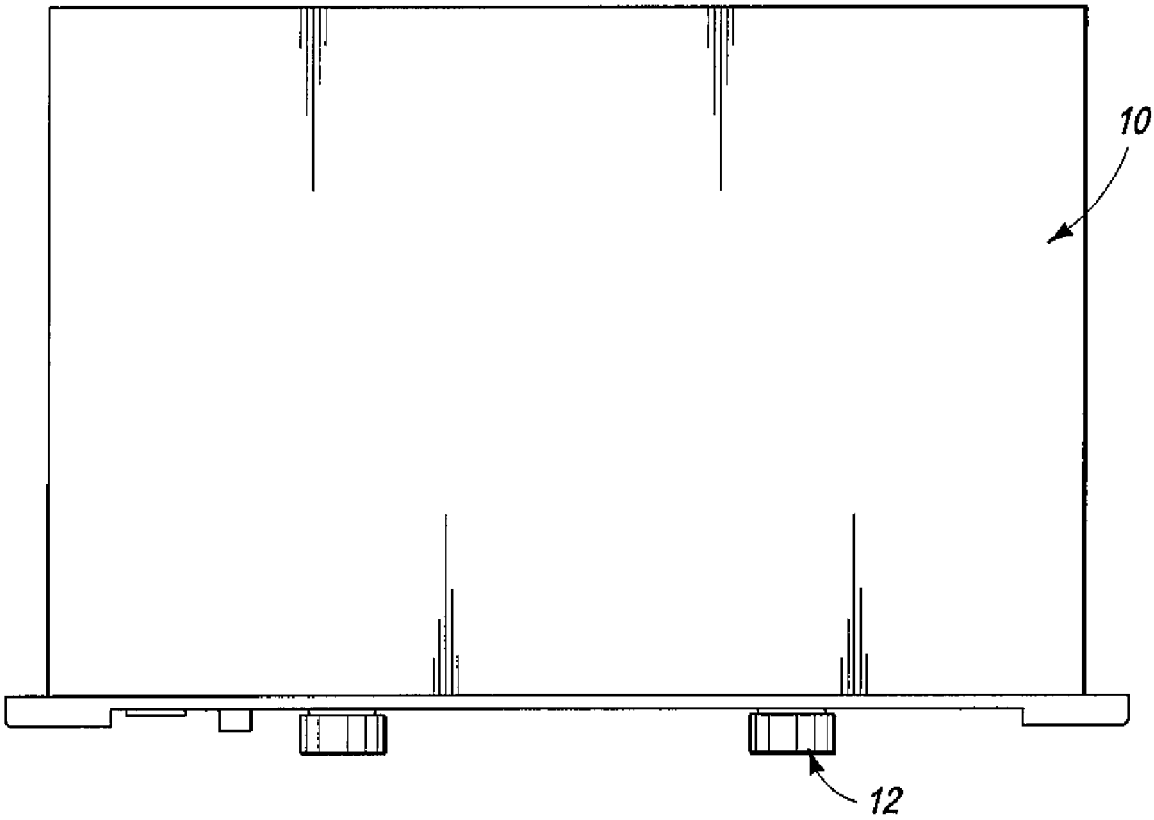
FIG. 2 is a top view of the equipment of FIG. 1, with the light tube assembly in the retracted state.
Figure 3:
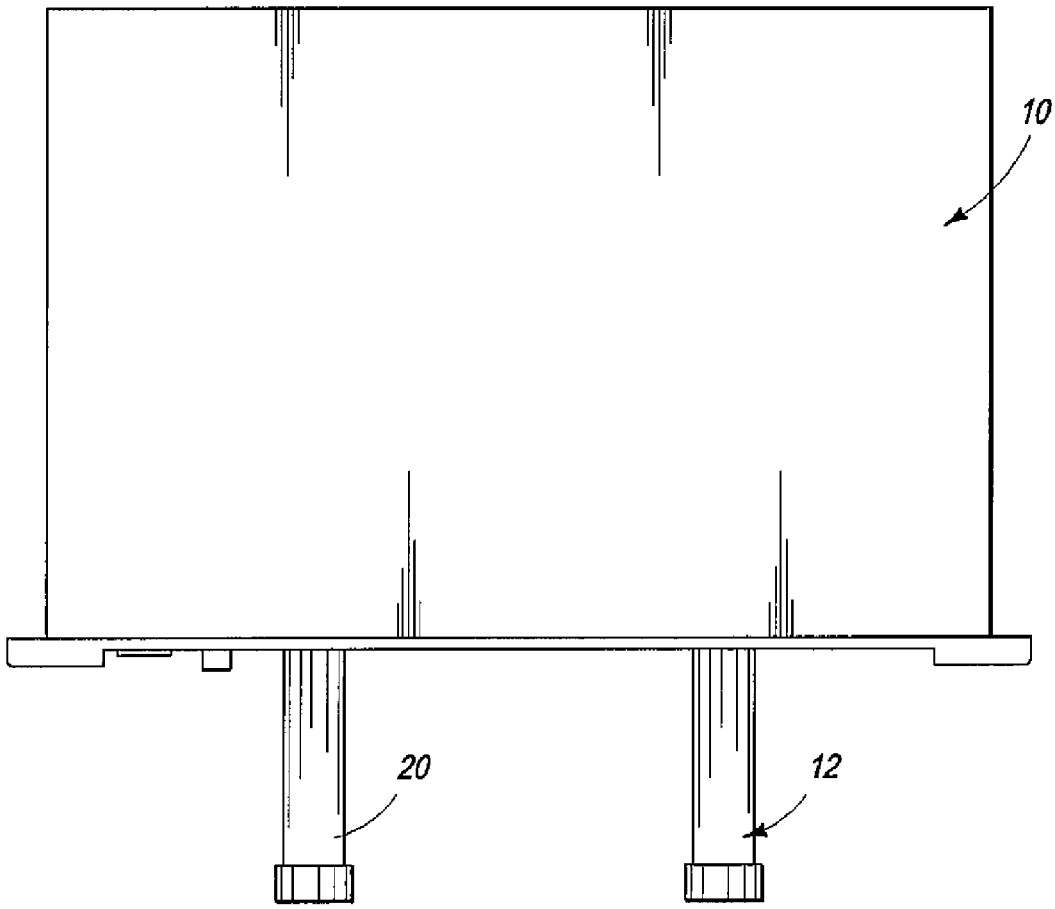
FIG. 3 is a top view of the equipment of FIG. 1, with the light tube assembly in an extended state.
Figure 4:
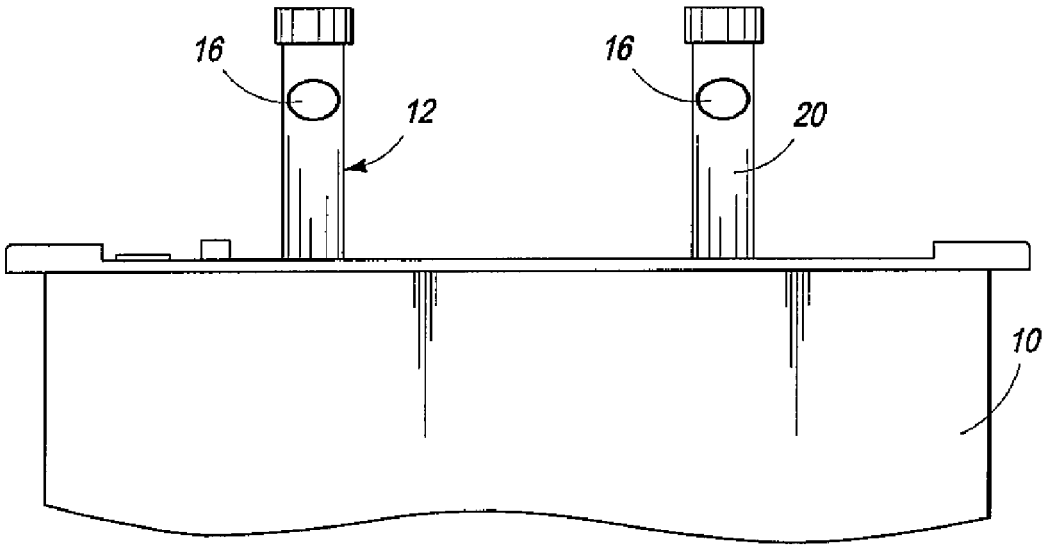
FIG. 4 is a bottom view of the equipment of FIG. 1, showing the light tube assembly in the extended state and light openings formed in the light tubes.

As illustrated in FIGS. 8-18, and as will be described in more detail herein, pull-out light tube assembly 12 is formed by a light tube 20 that is extendable from and retractable into a bushing or holder 30 that is mounted to a front panel of equipment 10. Light tube 20 may be retracted or pushed into bushing 30 when not in use, and may be extended or pulled out from bushing 30 when in use. FIGS. 1 and 2 illustrate light tube assembly 12 in a retracted position, and FIGS. 3 and 4 illustrate light tube assembly 12 in an extended position.

A decorative logo or symbol 14 is formed on a front end of light tube assembly 12. The front end of light tube assembly 12 on which logo 14 is formed may be, for example, a removable cap at the end of light tube 20, thereby facilitating exchange of the light bulb mounted therein. Alternatively, the front end of light tube assembly 12 on which logo 14 is formed may be an integral and non-removable part of light tube 20. As depicted in the drawings, logo 14 comprises the letter "F". However, logo or symbol 14 may be any desired or appropriate logo, symbol, letter or other marking. As will be described in more detail herein, light tube assembly 12 includes a mechanism for self-centering during retraction, thereby maintaining a centered and properly oriented appearance of logo 14 when retracted.

A lamp or bulb is mounted inside of light tube assembly 12. As shown in FIG. 4, a light opening 16 through which light from the internally-mounted lamp shines is formed at one end (the pulled out end) of light tube 20. As illustrated, light opening 16 is formed in a lower or bottom portion of light tube 20. However, light opening 16 may be formed in any desired part of light tube 20.

Light tube 20 is rotatable within bushing 30 so that light can be shined on a desired part of the equipment rack. Thus, when pulled out, light can be shined through light opening 16 to illuminate equipment directly below light tube assembly 12, or light tube 20 can be rotated within bushing 30 to aim light opening 16 in order to illuminate equipment to the sides of light tube assembly 12. When no longer in use, light tube 20 is pushed back into bushing 30.

Figure 5:
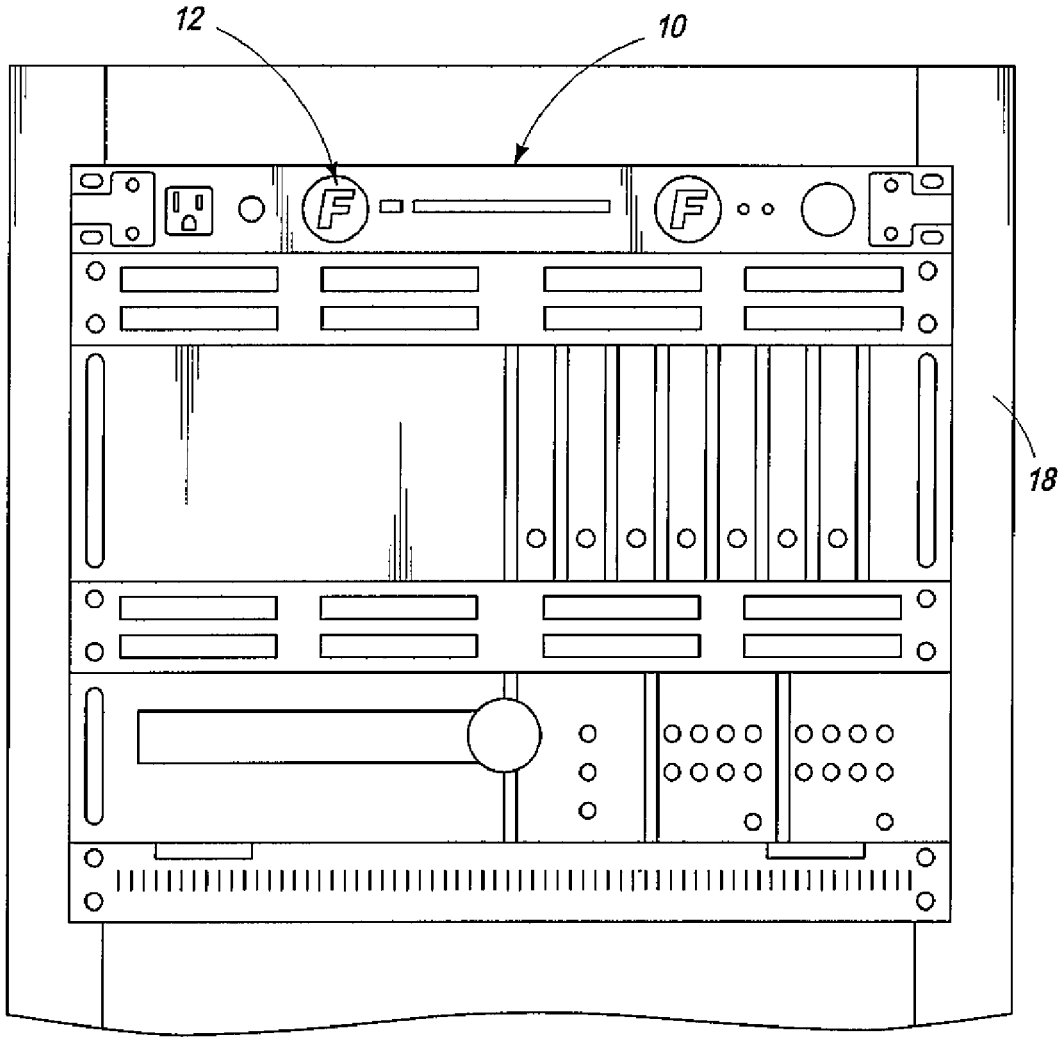
FIG. 5 is a front view of the equipment of FIG. 1, with the light tube assembly in the retracted state, as installed in an exemplary rack of equipment.
Figure 6:
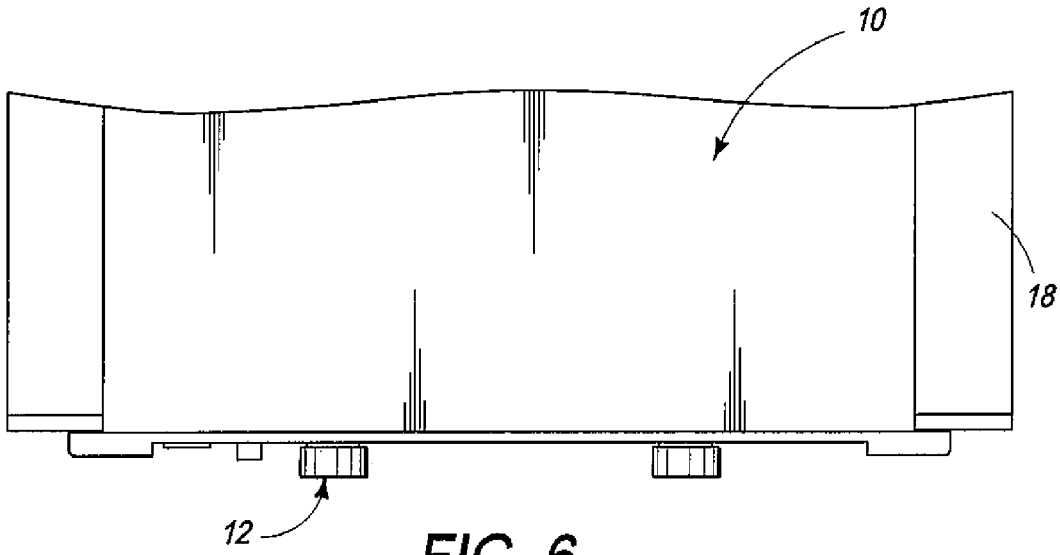
FIG. 6 is a top view of the rack of equipment of FIG. 5, with the light tube assembly in the retracted state.
Figure 7:
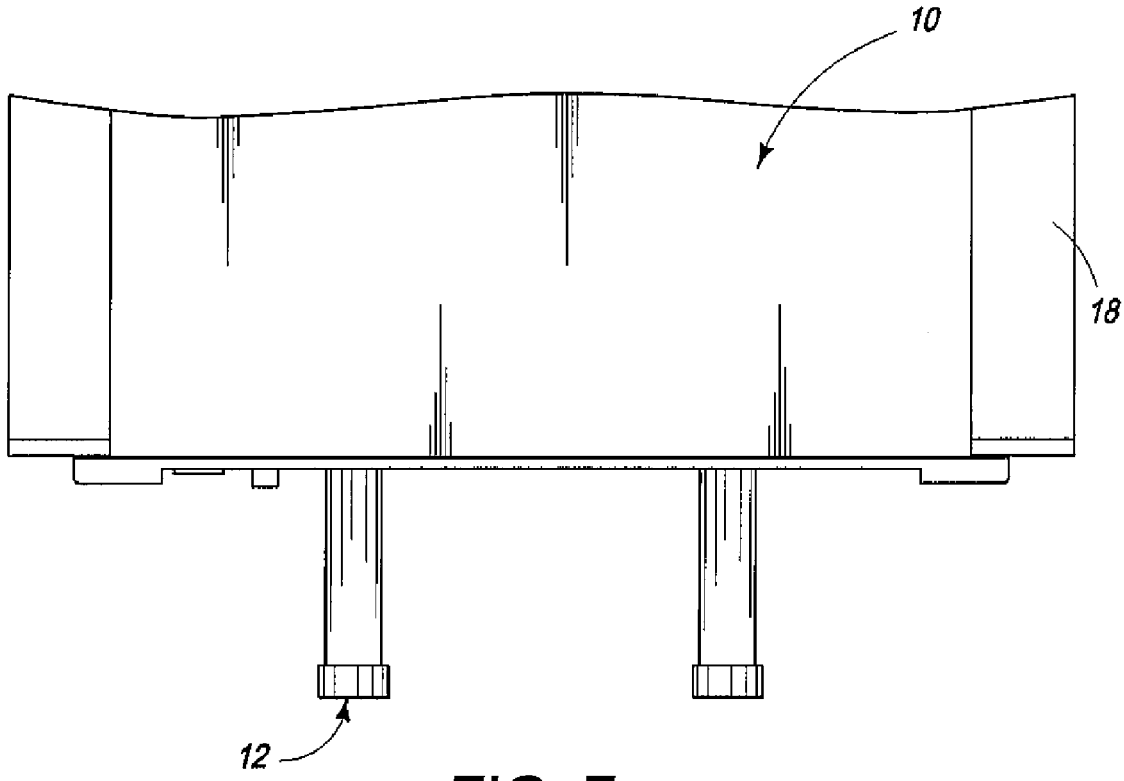
FIG. 7 is a top view of the rack of equipment of FIG. 5, with the light tube assembly in the extended state.

As previously mentioned, the equipment or component 10 in which light tube assembly 12 is mounted is typically installed in an equipment rack or system. FIGS. 5-7 show equipment 10 with light tube assembly 12 installed therein as mounted in a rack 18. FIGS. 5 and 6 show light tube assembly 12 in a retracted position, whereas FIG. 7 shows light tube assembly 12 in an extended position such that light can be shined from light tube assembly 12 in order to illuminate portions of rack 18 below equipment 10.

Figure 8:
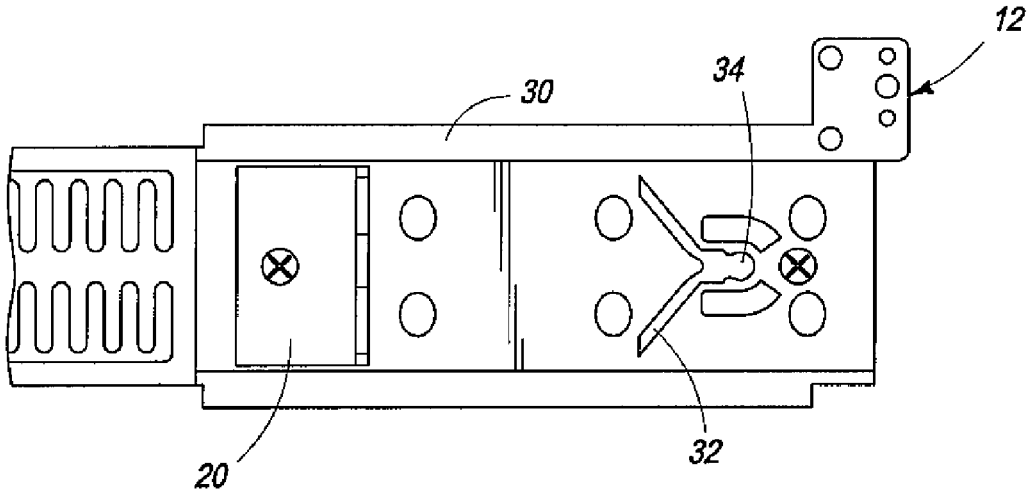
FIG. 8 is a top view of an assembled light tube assembly, including a light tube and a bushing, according to the present invention.
Figure 9:
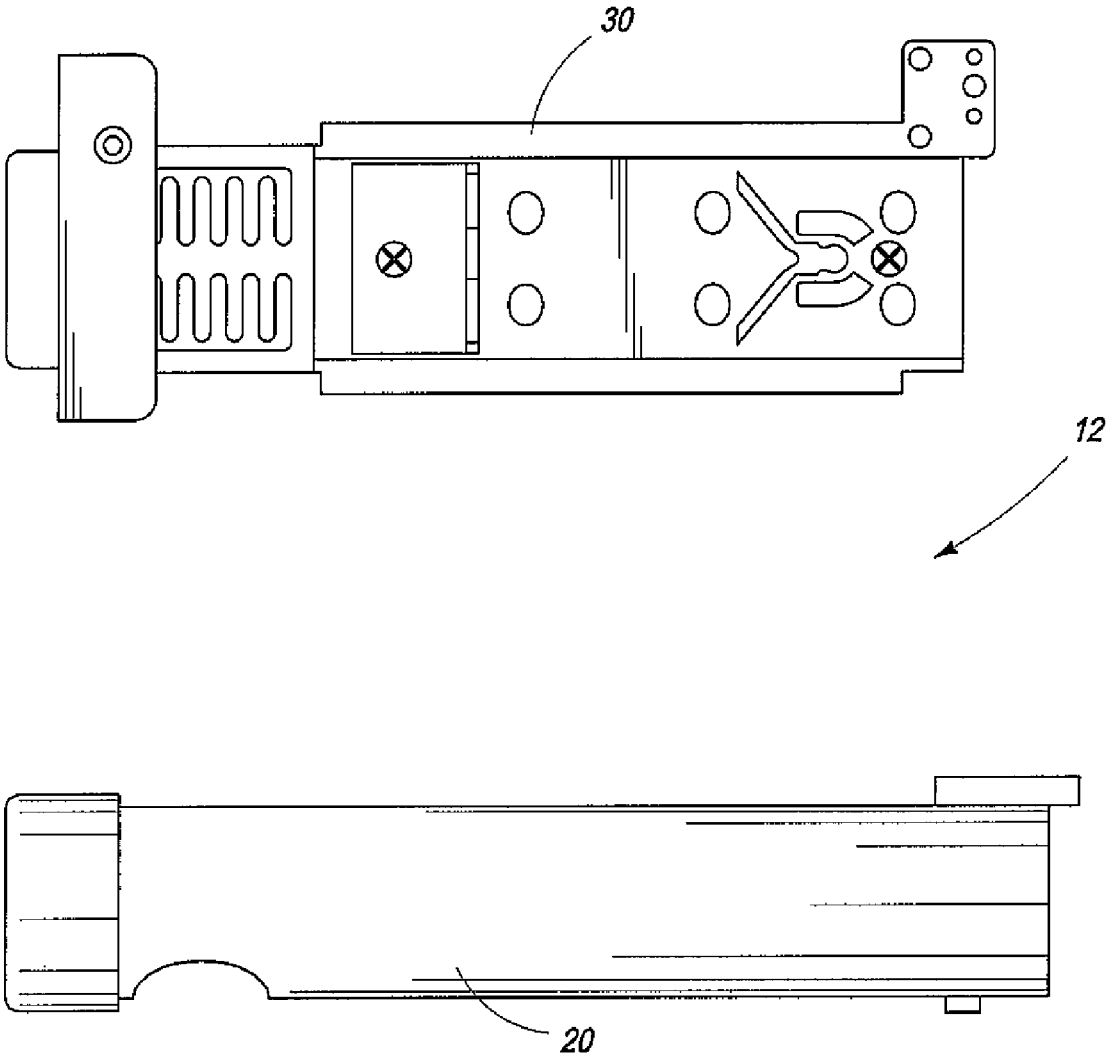
FIG. 9 is a top view of a disassembled light tube assembly, including the light tube and bushing.

As previously mentioned, and illustrated in FIGS. 8 and 9, each light tube assembly 12 includes a light tube 20 that is received within a bushing 30. Light tube 20 is movable within bushing 30, such that it may be extended (pulled-out) from or retracted (pushed-in) into equipment 10. Light tube 20 is also rotatable within bushing 30, such that the position of light opening 16 may be manipulated to shine light as desired. As such, to facilitate rotation, light tube 20 and bushing 30 preferably have a mating, cylindrical shape.

Figure 12:
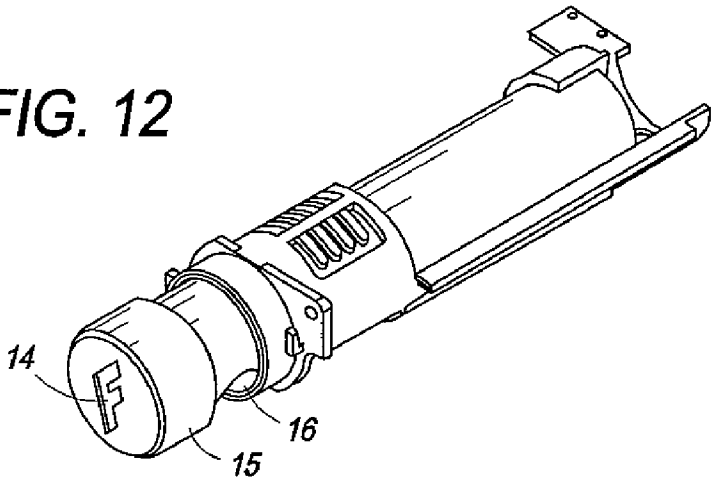
FIG. 12 is a perspective view of the light tube assembly in an extended and rotated position.
Figure 10:
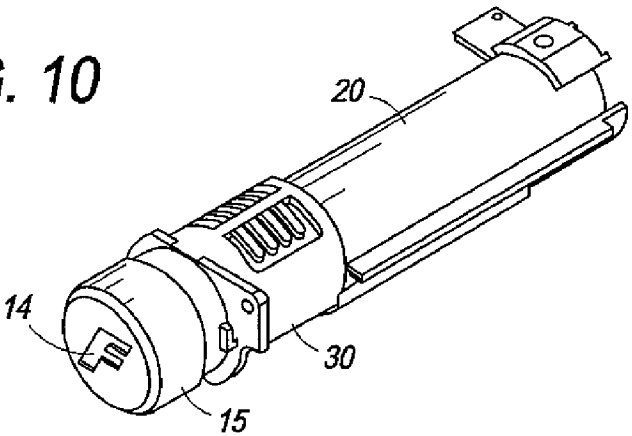
FIG. 10 is a perspective view of the light tube assembly in a retracted and centered position.
Figure 11:
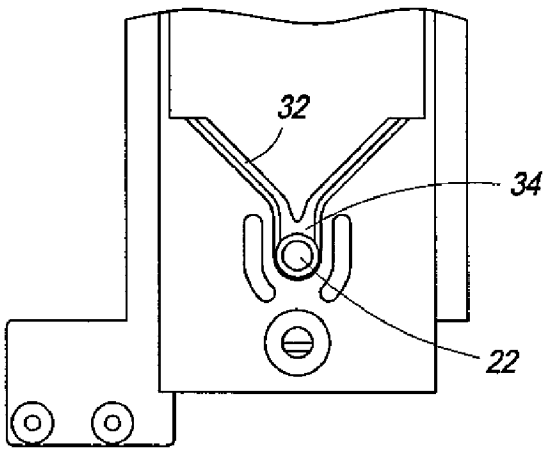
FIG. 11 is a view of the retracted and centered light tube assembly of FIG. 10, showing positioning of a guide pin formed on the light tube at an end of a guide pathway formed in the bushing.
Figure 14:
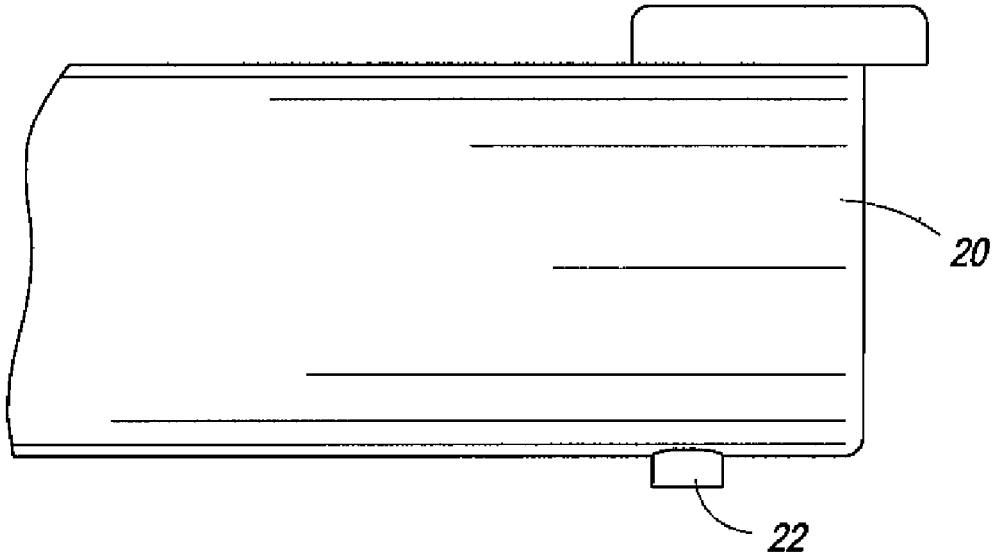
FIG. 14 is a side view of the light tube including the guide pin.
Figure 15:
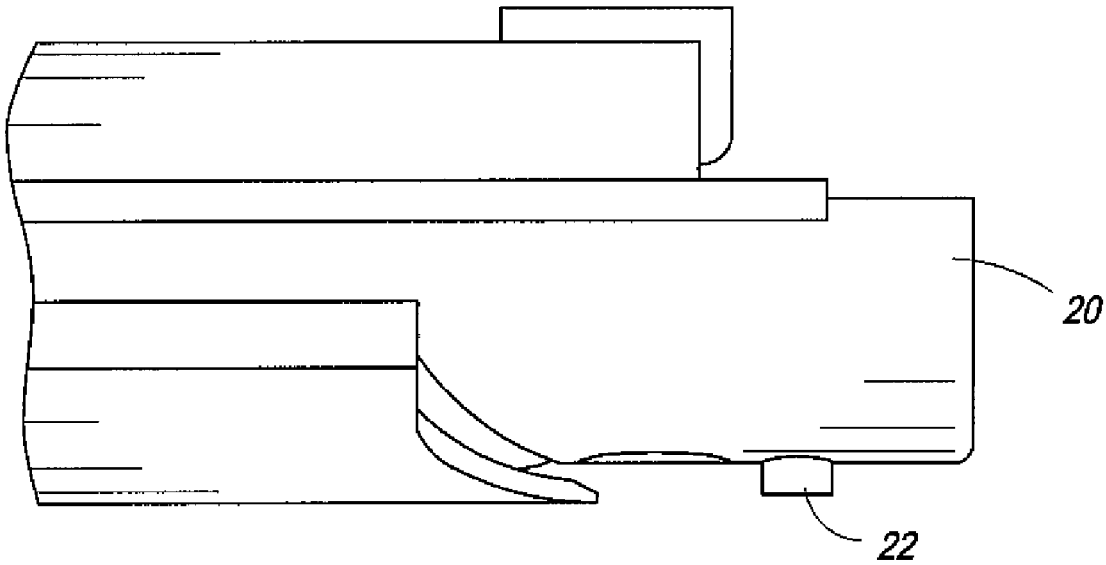
FIG. 15 is a side view of the light tube assembly, including the light tube with the guide pin and the bushing with the guide pathway.

As shown, for example, in FIGS. 10 and 12, logo 14 is formed at a front end 15 of light tube 20. FIG. 10 shows light tube 20 retracted into bushing 30 and centered, whereas FIG. 12 shows light tube 20 pulled out from bushing 30 and rotated, such that logo 14 is off-center and is tilted and improperly oriented. As will now be discussed in detail, pull-out light tube assembly 12 includes a self-centering mechanism such that light tube assembly 12 is returned to a centered position when retracted into bushing 30, such that logo 14 remains properly oriented and upright, and maintains a consistent and visually appealing appearance.

Figure 13:
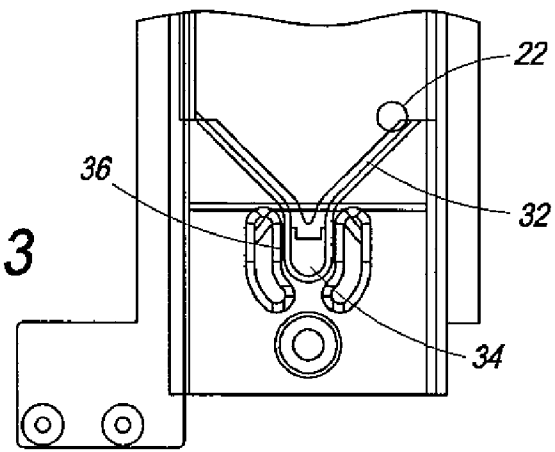
FIG. 13 is a view of the extended and rotated light tube assembly of FIG. 12, showing the guide pin formed on the light tube and the guide pathway formed in the bushing.

As shown in FIGS. 11 and 13-15, light tube 20 has a guide pin or knob 22 formed on a lower surface thereof. Bushing 30 has a guide channel or pathway 32, in the form of a V-shaped groove, that receives and guides pin 22 towards a centered position when light tube 20 is pushed into bushing 30. In a fully retracted and centered position (FIG. 11), pin 22 fits within a receptacle or slot 34 formed at the end of V-shaped groove 32, such that light tube 20 is centered and cannot be rotated until light tube 20 is pulled out from bushing 30 (FIG. 13), thereby removing pin 22 from receptacle 34 and allowing light tube 20 to rotate within bushing 30. As can be seen in FIG. 13, retention detents 36 may be formed in receptacle 34 of pathway 32 in order to retain tube 20 in a centered position until force is exerted to pull out tube 20.

Figure 16:
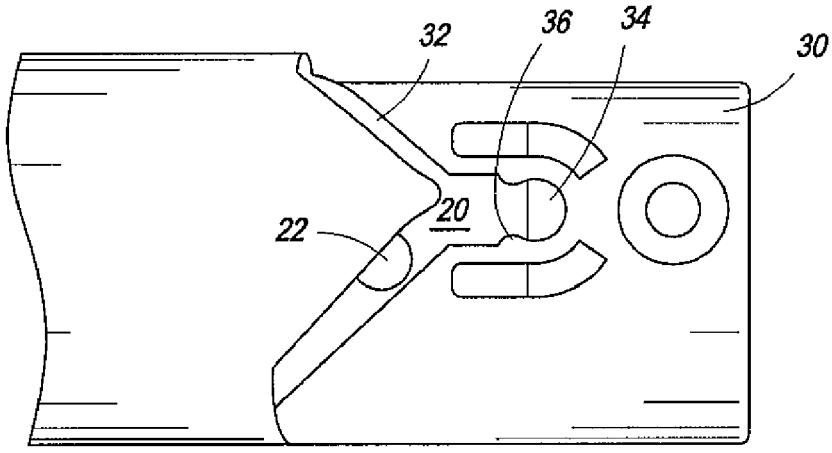
FIG. 16 is a side view of the light tube assembly, showing retraction of the light tube.
Figure 17:
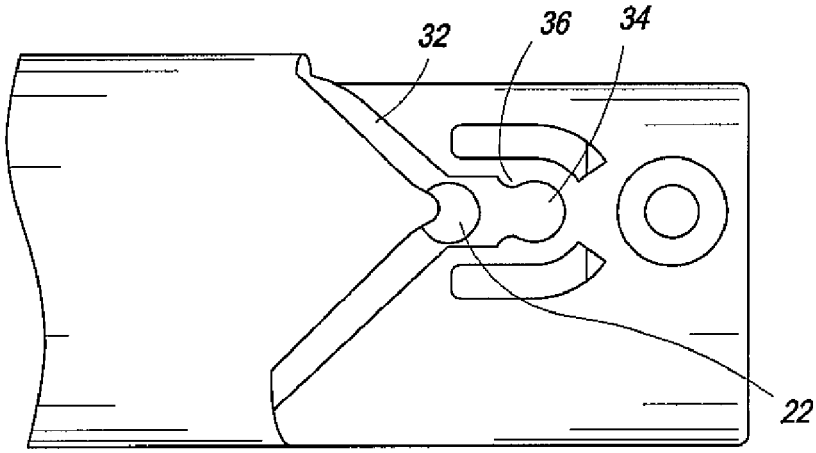
FIG. 17 is a side view of the light tube assembly, showing retraction of the light tube to a near-centered position.
Figure 18:
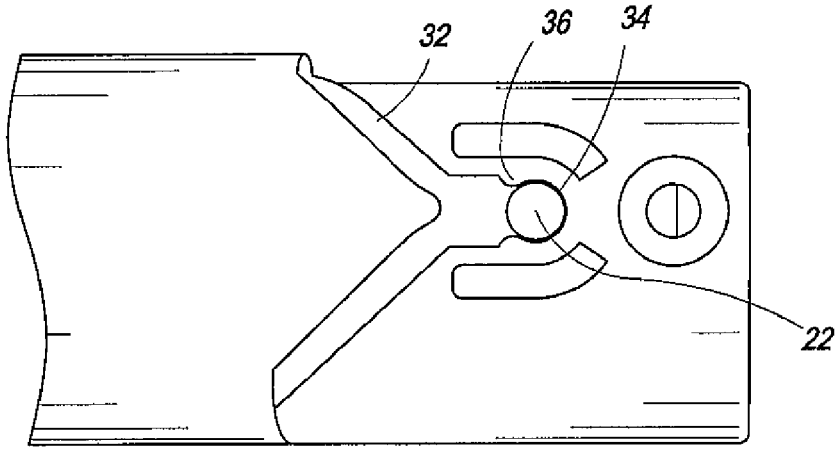
FIG. 18 is a side view of the light tube assembly, showing retraction of the light tube to a fully-centered position.

FIGS. 16-18 illustrate the self-centering interaction of guide pin 22 and guide pathway 32 as light tube 20 is pushed or retracted into bushing 30. As tube 20 is pushed in, guide pin 22 contacts V-groove or channel 32, thereby interfering with and constricting the range of rotation of tube 20 within bushing 30 (FIG. 16). As light tube 20 is pushed further in (FIG. 17), guide pin 22 arrives at the end of V-groove 32 and begins to enter the slot or receptacle 34 formed at the end of V-groove 32. In FIG. 17, light tube 20 is almost fully pushed into bushing 30, and is almost fully-centered. FIG. 18 shows light tube 20 in a fully-centered position within bushing 30. Guide pin 22 is pushed completely into slot or receptacle 34, and is held therein by detents 36, such that a minimal pull-out force must be exerted in order to move light tube 20 from its fully-centered position.

The configuration of pull-out light tube assembly 12, as shown and described herein, represents a significant improvement over prior art assemblies. When previously known light tubes are pulled out from their bushings and rotated, and are then pushed back or retracted into the bushing without being rotated back to the original position, there is no mechanism other than manual rotation to re-center the light tube within the bushing. Thus the logo at the front end of the light tube will remain at a rotated and improperly oriented position, thereby detracting from the appearance of the light tube assembly and equipment rack in which it is installed. The user of the light tube will very likely forget or neglect to re-center the light tube, thereby leaving the light tube assembly in an off-centered and visually less appealing state. The present invention overcomes this problem by providing the above-described mechanism that self-centers the light tube within the bushing whenever the light tube is pushed back or retracted into the bushing, such that the front logo is always maintained in a properly oriented, upright and visually appealing state.

While particular embodiments of the invention have been described, it should be understood that these embodiments are exemplary, and not restrictive. Various modifications will be apparent to those of skill in the art and are within the scope of the present invention as set forth in the following claims.

The invention claimed is:

1. A pull-out light tube assembly to be mounted in an equipment component, comprising:

a bushing;

a light tube received within the bushing, wherein the light tube can be pulled out from the bushing and retracted into the bushing; and a mechanism for self-centering the light tube within the bushing when the light tube is retracted into the bushing.

2. A pull-out light tube assembly as claimed in claim 1, wherein the mechanism for self-centering the light tube within the bushing comprises:

a guide pin formed in the light tube; and a guide channel formed in the bushing that receives and guides the guide pin to a centered position.

3. A pull-out light tube assembly as claimed in claim 2, wherein the guide channel is a V-shaped groove.

4. A pull-out light tube assembly as claimed in claim 3, wherein the V-shaped groove includes a receptacle formed at an end thereof to receive and maintain the guide pin in the centered position.

5. A pull-out light tube assembly as claimed in claim 4, wherein a detent is formed in the receptacle in order to secure the guide pin in the centered position.

6. A pull-out light tube assembly as claimed in claim 1, wherein a logo is formed at a front end of the light tube, and wherein the mechanism for self-centering operates to maintain the logo in a properly oriented position when the light tube is retracted within the bushing.

7. An audio or video component comprising the pull-out light tube assembly of claim 1.

8. An equipment rack comprising the audio or video component of claim 7.

* * * * *